US005254822A

United States Patent [19]

Nara

[11] Patent Number: 5,254,822

[45] Date of Patent: Oct. 19, 1993

[54] ELECTRONIC COMBUSTION FURNACE

[75] Inventor: Akikazu Nara, Kyoto, Japan

[73] Assignee: Naraseiki Kabushiki Kaisha, Kyoto, Japan

[21] Appl. No.: 736,622

[22] Filed: Jul. 26, 1991

[30] Foreign Application Priority Data

Aug. 10, 1990 [JP] Japan ..... 2-213502

[51] Int. Cl.[5] ..... H05B 6/64

[52] U.S. Cl. ..... 219/10.55 R; 219/10.55 A; 219/10.55 F; 219/10.55 M; 219/10.67; 219/121.61; 75/351; 426/243; 437/126; 437/243

[58] Field of Search ..... 219/10.55 R, 10.55 E, 219/10.55 F, 10.55 M, 10.55 A, 10.67, 76.1, 121.61, 121.66; 426/243; 99/DIG. 14; 437/86, 126, 133, 243; 75/351, 368

[56] References Cited

U.S. PATENT DOCUMENTS 3,701,872 10/1972 Levinson ..... 219/10.55 R
3,777,099 12/1973 Levinson ..... 219/10.55 R
3,881,027 4/1975 Levinson ..... 219/10.55 R
4,015,100 3/1977 Gnanamuthu et al. ..... 219/121.61
4,168,998 9/1979 Hasegawa et al. ..... 219/10.67
4,806,718 2/1989 Seaborne et al. ..... 219/10.55 E
4,822,966 4/1989 Matsubara ..... 219/10.55 M
4,921,531 5/1990 Nagle et al. ..... 75/351

FOREIGN PATENT DOCUMENTS 287549 10/1988 European Pat. Off. .
58-060532 4/1983 Japan .
62-059507 3/1987 Japan .
62-256702 11/1987 Japan .

*Primary Examiner*—Bruce A. Reynolds
*Assistant Examiner*—Tu Hoang
*Attorney, Agent, or Firm*—Leydig, Voit & Mayer

[57] ABSTRACT

An electronic combustion furnace includes a heating element comprising a heat proof vessel and a mixture of carbon powder and aluminum powder vacuum sealed within the vessel. When the heating element is irradiated with microwaves, it is heated to a high temperature which can melt and combust waste materials within the furnace. An exhaust gas purifying device purifies gas generated within the furnace.

15 Claims, 3 Drawing Sheets

ELECTRONIC COMBUSTION FURNACE

BACKGROUND OF THE INVENTION

The present invention relates to an electronic combustion furnace using a heating element, and more particularly to an electronic combustion furnace for melting objects with heat generated by the heating element when irradiated with microwaves.

Hitherto, electronic ranges for heating objects by microwaves have been widely used. However, the main purpose of electronic ranges is for cooking, reheating, or thawing foods. Therefore, it is not possible for such electronic ranges to heat, melt, and dispose of objects. Therefore, there has been no apparatus for completely disposing of objects by heating, because it has been difficult for the conventional apparatuses to increase the temperature of the object to be heated high enough to destroy the object.

SUMMARY OF THE INVENTION

The object of the present invention is to solve the above-mentioned problems and to provide a high-temperature heating element which develops a high temperature when irradiated with microwaves. It is a further object to provide an electronic combustion furnace for disposing of objects by the high temperature heat generated by the heating element.

DESCRIPTION OF THE PREFERRED EMBODIMENTS

One embodiment of the present invention will be explained hereinafter with reference to the attached drawings.

Figure 1:
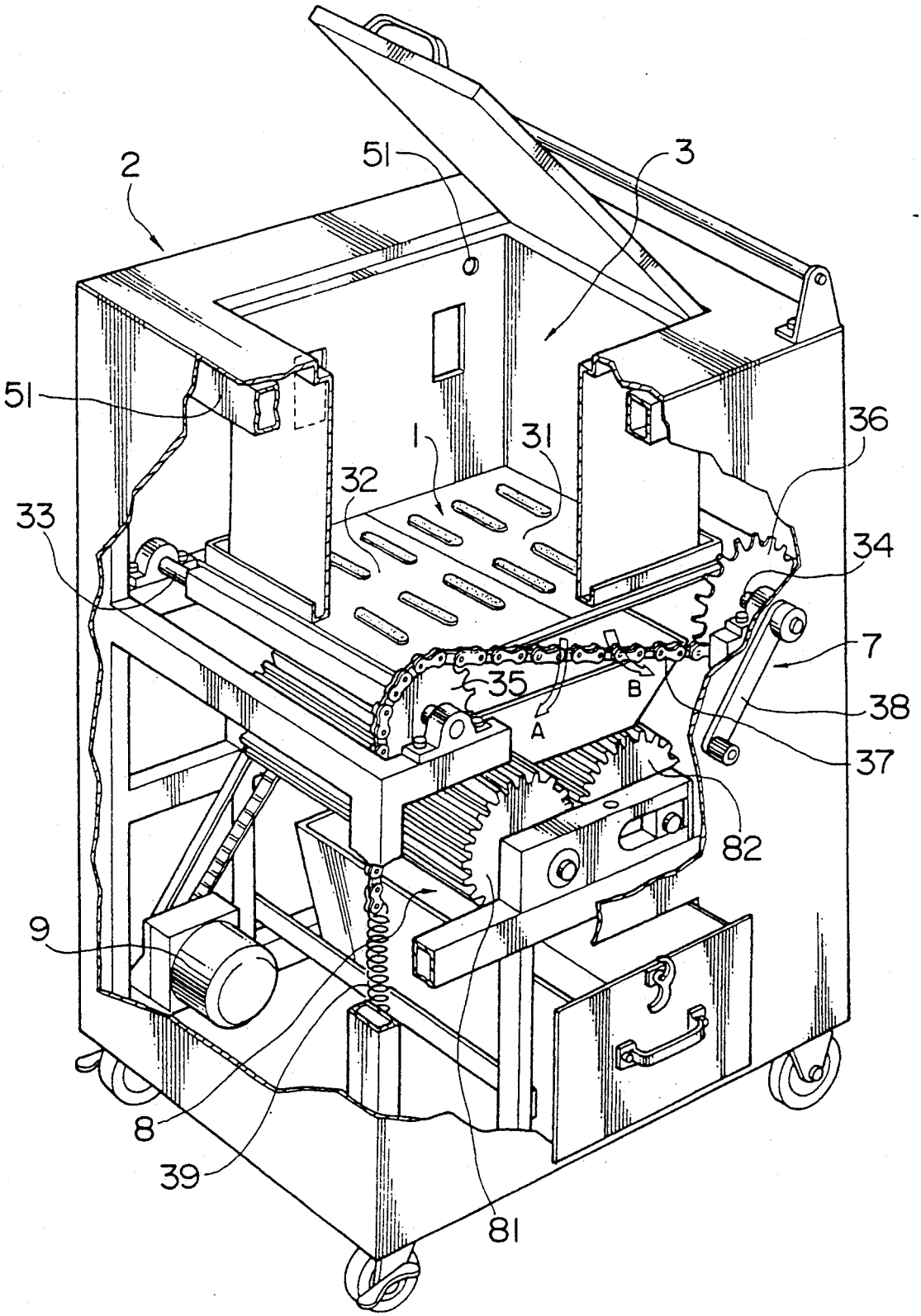
FIG. 1 is a partially broken perspective view of an embodiment of an electronic combustion furnace using a heating element according to the present invention.

FIG. 1 is a schematic perspective view of an embodiment of an electronic furnace 2 for heating and disposing of an object and a plurality of heating elements 1 used for heating the object.

Figure 2:
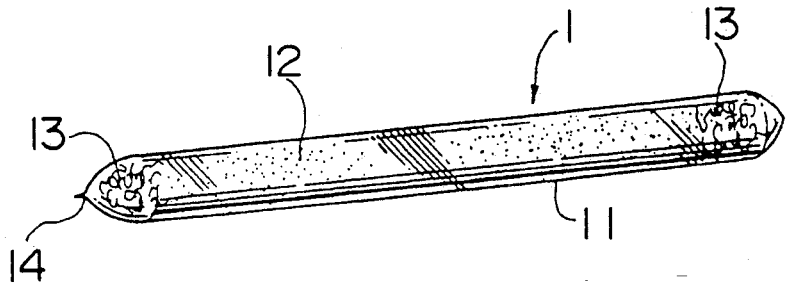
FIG. 2 is a perspective view showing the structure of the heating element.

FIG. 2 is a perspective view showing the structure of the heating element 1 generating high temperature heat. A mixture 12 of a carbon powder and an aluminum powder fills a vacuum-sealed quartz tube 11. Quartz wool 13 is disposed at both end portions of the quartz tube 11 in order to seal the mixture 12 and both ends of the quartz tube 11 are sealed. The quartz tube 11 may have a diameter of about 8 mm and a length of about 100 mm.

If the heating element 1 is irradiated with microwaves having a high frequency of about 2,450 MHz such as ordinarily used for an electronic range or the like, the carbon powder is mainly heated to a high temperature due to a dielectric heating function. By adjusting the mixture ratio of the carbon powder and the aluminum powder, it is possible to adjust the generated temperature within a range from about 30° C. to about 1,600° C. Here, the melting temperature of the quartz tube is about 1,200° C. As mentioned above, the temperature of the heating element is changed in accordance with the mixture ratio. The following table shows an experimentally determined relationship between the time required for the mixture 12 (approximately 30 g) to be heated to a temperature within the range from about 600° C. to about 700° C. and the mixture ratio (volume ratio).

| | 1 min. | 1 min. 10 sec | 1 min. 30 sec | 2 min. | 2 min. |
|---|---|---|---|---|---|
| Carbon | 2 | 1.5 | 1.2 | 1 | 0.5 |
| Aluminum | 0 | 0.5 | 0.8 | 1 | 1.5 |

As is apparent from the above table, if there is no aluminum powder, the heating element reaches the high temperature range of 600° C.–700° C. in only one minute, but as the amount of aluminum powder is increased, the time required to reach the predetermined temperature is also increased. This means that the aluminum powder functions to restrict an abrupt rise in temperature of the heating element and to retain the high temperature of the heating element. Furthermore, if the amount of the aluminum powder is increased rather than the amount of the carbon powder, not only does the temperature increase more slowly but also the obtained temperature may be restricted to about 400° C. to 500° C.

The combustion furnace 1 is mainly composed of a box type receiving portion 3 for receiving an object to be heated, twelve heating elements 1 disposed on the bottom of the receiving portion 3, a microwave generator 4 (FIG. 3) such as a magnetron, a suction device 5 for sucking a gas such as carbon oxide generated during combustion by utilizing a vacuum pump (not shown), an exhaust gas purifying device 6 composed of a microwave generator 61 and a high temperature heating element 62 disposed in a suction path of the suction device 5, a dropping mechanism 7 for dropping dregs (not shown) in the receiving portion 3 downwardly, and a smashing mechanism 8 for smashing the dropped residue between gears.

The inner wall of the receiving portion 3 is composed of a material such as stainless steel and its bottom portion is composed of two doors 31 and 32 which are rotatable around shafts 33 and 34, respectively, as shown by arrows A and B. The shafts 33 and 34 are fixed to gears 35 and 36 connected to each other by a chain 37. If a handle 38 fixed to shaft 34 is rotated in the counter-clockwise direction against the resilient force of a spring 39, the doors 31 and 32 are rotated in the direction shown by arrows A and B, respectively, thereby dropping the residue (not shown) stacked on the bottom portion of the receiving portion. On the bottom surface of the receiving portion is mounted a heat-resisting material such as asbestos, and the heating elements are fixed on the heat-resisting material with a heat-resisting adhesive.

Figure 3:
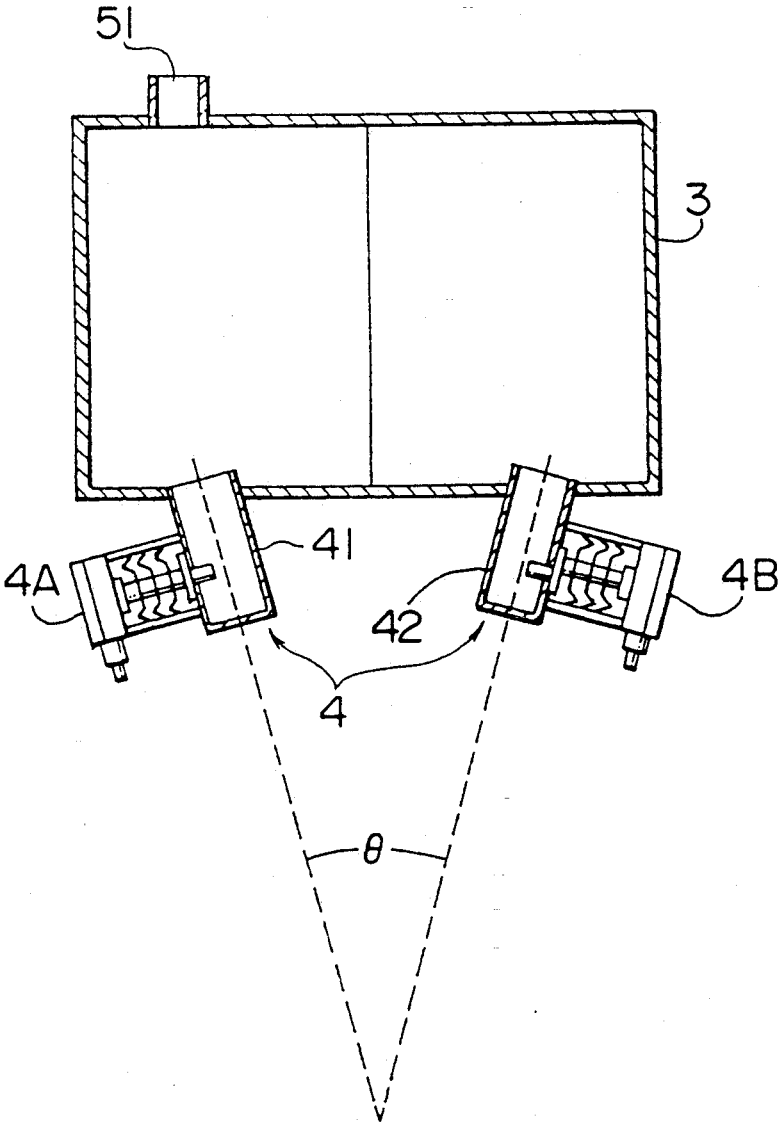
FIG. 3 is a plan view showing the disposition of a microwave generator mounted in a receiving portion of the electronic combustion furnace.
Figure 4:
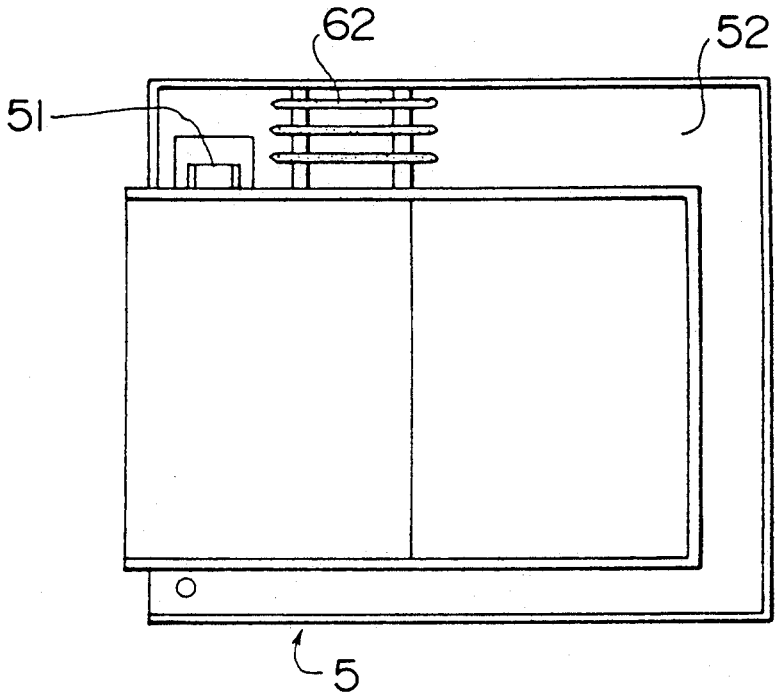
FIGS. 4 and 5 are respectively a plan view and a side view showing a suction device and an exhaust purifying device mounted on the periphery of the receiving portion.
Figure 5:
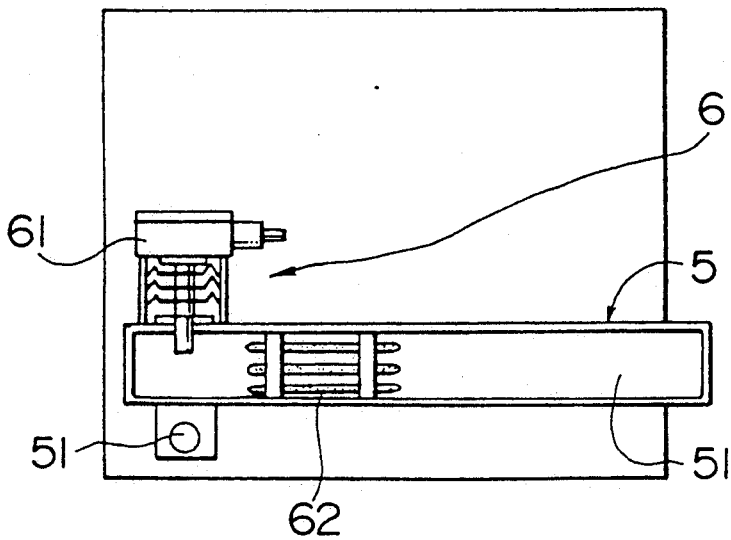

Magnetron generators 4A and 4B are employed as an energy source for heating the heating elements to a high temperature, as shown in FIG. 3. In a conventional electronic range, a single magnetron generator is employed, and if two or more magnetron generators are used, it is very difficult to dispose the magnetron generators so as not to produce any interference between them. According to the present invention, however, the magnetron generators are disposed as shown in FIG. 3 in such a manner that the axes of the waveguide tubes 41 and 42 respectively connected to the output sides of the magnetron generators 4A and 4B intersect to define an angle Θ. This angle Θ may be set smaller than 90°. The magnetron generators may generate microwaves having a frequency of 2,450 MHz such as generally used for usual electronic ranges. As an electric source for driving the generators, a usual one used for a usual electronic range may be employed, so an explanation thereof will be omitted.

Smoke comprising carbon oxide, steam or the like generated within the combustion furnace is sucked into a duct 52 from a smoke inlet 51 mounted at the side wall of the receiving portion 3 by using a vacuum pump (not shown). The smoke sucked from the smoke inlet 51 into the duct 52 is further burned by a heating element 62 driven by the magnetron generator 61 of the exhaust gas purifying device 6, and a a result the smoke is purified and discharged to the outside of the furnace. Thus, the sucked smoke is heated to a high temperature of about 700° C., and therefore gas such as carbon monoxide is oxidized to become a harmless gas (carbon oxide), and in addition germs are killed by sterilization.

The dropped residue is smashed by the rotation of gears 81 and 82 of the smashing mechanism 8. Since the shaft of one gear 82 is supported by a bearing in the form of an elongated hole, it is possible to prevent the gears 81 and 82 from destruction by shifting the shaft in the elongated hole, even if a material which is difficult to smash by the gears is inserted therebetween. The gears 81 and 82 are driven by a driving motor 9.

The operating temperature of the high-temperature heating elements can be controlled in a well-known manner by using a temperature sensor (not shown).

The present invention is not limited to the above-mentioned embodiment. Therefore, the heating elements are not limited to a rod-like shape, and they may be circular or plate-like. Moreover, it is possible to disperse at least carbon powder or a mixture of carbon powder and aluminum powder within a quartz material. It is also possible for the heating elements to be in the shape of a dish or a pan. Moreover, it is also possible to provide more than two microwave generators.

As mentioned above, according to the present invention a high temperature is easily and quickly obtained by utilizing a high temperature heating element which generates heat when irradiated with microwaves. Therefore, waste materials from medical facilities such as waste gauze, surgical materials made of paper, bandages, used injection needles, filters used for artificial kidney dialysis, and organs extracted in surgical operations and raw kitchen waste can be easily burnt.

What is claimed is:

1. A heating element for generating heat when irradiated with microwaves comprising a heat-proof container and a mixture of carbon powder and aluminum powder vacuum sealed within the container.

2. A heating element according to claim 1 wherein the heat-proof container is a quartz tube.

3. A heating element as claimed in claim 2 wherein the quartz tube has first and second ends, the heating element further comprising quartz wool disposed within the quartz tube at opposite ends thereof with the mixture between the quartz wool.

4. An electronic combustion furnace for disposing of waste materials comprising a heating element including a heat-proof container and a mixture of carbon and aluminum powders vacuum sealed within the container, and means for heating and melting an object in the furnace by irradiating the heating element with microwaves.

5. An electronic combustion furnace according to claim 4 wherein the heat-proof container is a quartz tube.

6. An electronic combustion furnace for disposing of waste materials comprising:

a box for receiving an object to be melted, the box having a bottom portion, an inside, and an outside;

a suction path communicating between the inside and the outside of the box;

a first heating element mounted on the bottom portion and including a first heat-proof container and carbon powder vacuum sealed within the first container;

a microwave generator mounted adjacent the box and disposed to irradiate the first heating element with microwaves and cause the first heating element to be raised to a temperature for heating and melting an object disposed in the box;

a suction device which carries gas generated by combustion within the box along the suction path to the outside of the box; and an exhaust gas purifying device disposed along the suction path for purifying gas passing along the suction path.

7. A furnace as claimed in claim 6 wherein the exhaust gas purifying device comprises a second heating element disposed along the suction path and a microwave generator directed at the second heating element, the second heating element comprising a second heat-proof container and a mixture of carbon powder and aluminum powder vacuum sealed within the second container.

8. A furnace as claimed in claim 6 wherein the exhaust gas purifying device comprises a second heating element disposed along the suction path and a microwave generator directed at the second heating element, the second heating element comprising a second heat-proof container and a mixture of carbon powder and aluminum powder vacuum sealed within the second container.

9. An electronic combustion furnace for combustion of waste materials comprising:

a heat-resistant combustion chamber for holding a waste material to be combusted;

a first heating element disposed in the combustion chamber and comprising a first heat-proof container and a mixture of carbon powder and aluminum powder vacuum sealed within the first container; and a microwave generator disposed to direct microwaves at the first heating element.

10. A furnace as claimed in claim 9 wherein the combustion chamber comprises a collecting surface for collecting combusted solids, the furnace further comprising removing means for removing combusted solids from the surface and means for crushing the combusted solids removed by the removing means.

11. A furnace as claimed in claim 10 wherein the removing means comprises means for pivoting the collecting surface from a horizontal position to a tilted position in which the collected solids fall off the collecting surface.

12. A furnace as claimed in claim 10 wherein the crushing means comprises a set of gears disposed adjacent the collecting surface and means for rotating the gears, wherein the removing means removes combusted solids from the collecting surface to between the gears.

13. A furnace as claimed in claim 9 further comprising a suction device for removing gas from the combustion chamber along a suction path and an exhaust gas purifying device disposed along the suction path for purifying the gas.

14. A furnace as claimed in claim 9 comprising a plurality of microwave generators directed at the first heating element and having intersecting axes defining an acute angle therebetween.

15. A furnace as claimed in claim 9 wherein the first heating element is disposed on the collecting surface.

* * * * *